US006925742B1

(12) United States Patent
Van Zyl

(10) Patent No.: US 6,925,742 B1
(45) Date of Patent: Aug. 9, 2005

(54) FIREARM

(75) Inventor: Nicolaas Cornelius Van Zyl, Nigel (ZA)

(73) Assignee: Africa Outdoors ACS (Proprietary) Limited, Nigel (ZA)

( * ) Notice: Subject to any disclaimer, the term of this patent is extended or adjusted under 35 U.S.C. 154(b) by 0 days.

(21) Appl. No.: 09/890,669

(22) PCT Filed: Feb. 10, 2000

(86) PCT No.: PCT/ZA00/00022

§ 371 (c)(1),
(2), (4) Date: Aug. 3, 2001

(87) PCT Pub. No.: WO00/47942

PCT Pub. Date: Aug. 17, 2000

(30) Foreign Application Priority Data

Feb. 11, 1999 (ZA) ..... 99/1099

(51) Int. Cl.[7] ..... F41A 17/00
(52) U.S. Cl. ..... 42/70.01; 42/70.11; 42/1.01; 89/41.05
(58) Field of Search ..... 42/70.01, 70.11, 42/106, 1.01; 89/41.05

(56) References Cited

U.S. PATENT DOCUMENTS 3,785,261 A * 1/1974 Ganteaume
3,911,451 A * 10/1975 Vockenhuber
4,290,219 A * 9/1981 Boller et al. ..... 42/70.11
4,309,095 A * 1/1982 Buckley
4,630,911 A * 12/1986 Paul
4,835,621 A * 5/1989 Black
4,907,022 A * 3/1990 Myers
4,989,024 A * 1/1991 Myers
5,062,232 A * 11/1991 Eppler ..... 42/70.11
5,287,644 A * 2/1994 Bolduc ..... 42/106
5,301,448 A * 4/1994 Petrick et al. ..... 42/70.01
5,366,229 A * 11/1994 Suzuki
5,467,403 A * 11/1995 Fishbine et al.
5,493,621 A * 2/1996 Matsumura
5,502,915 A 4/1996 Mendelsohn et al.
5,603,179 A 2/1997 Adams
5,636,464 A 6/1997 Ciluffo
5,826,360 A * 10/1998 Herold et al.
6,000,163 A * 12/1999 Gordon ..... 89/41.05
6,185,852 B1 * 2/2001 Whalen et al. ..... 42/70.11
6,237,271 B1 * 5/2001 Kaminski ..... 42/70.01
6,286,240 B1 * 9/2001 Collins ..... 42/1.01

(Continued)

FOREIGN PATENT DOCUMENTS

DE 19831690 9/1999

(Continued)

*Primary Examiner*—Michael J. Carone
*Assistant Examiner*—L. Semunegus
(74) *Attorney, Agent, or Firm*—The Webb Law Firm

(57) ABSTRACT

According to the present invention a firearm device comprises a firearm; safety means for impeding an unauthorized person to fire the firearm; and information storage means for recording and storing at least one aspect of the group consisting of an image in the direction in which a shot is in use fired, sound at about the time when a shot is in use fired, time when a shot is in use fired, and location of the firearm.

18 Claims, 3 Drawing Sheets

U.S. PATENT DOCUMENTS

| | | | | |
|---|---|---|---|---|
| 6,415,542 | B1 * | 7/2002 | Bates et al. | 42/70.11 |
| 6,449,892 | B1 * | 9/2002 | Jenkins | 42/1.01 |
| 6,477,801 | B1 * | 11/2002 | O'dwyer | 42/70.11 |
| 6,539,661 | B2 * | 4/2003 | Hope | 89/41.05 |

FOREIGN PATENT DOCUMENTS

| | | |
|---|---|---|
| WO | 9511419 | 4/1995 |
| WO | 9855817 | 12/1998 |

* cited by examiner

FIREARM

TECHNICAL FIELD

This invention relates to a firearm device.

BACKGROUND ART

It is well known that firearms are often misused, not only by unauthorised users, but also by owners of the firearms. This misuse leads to opposition to the use and carry of firearms. There is accordingly a great need for a firearm that is less attractive to be stolen, and more difficult to be used by unauthorised persons. At the same time it would also be a huge advantage if the firearm could in some way discourage misuse thereof.

International patent application number PCT/AU98/00413 discloses security measures for electronically operated ammunition and firearms such as pistols. The electronic controls of the pistol disclosed herein may be armed or disarmed electronically and includes encoding means which arms the electronic controls to "enable firing of the secured weapon upon the monitoring authorized code". This code may be electronically personalized to the individual using the firearm or authorized to use a firearm. The code may provided on a swipe card or the like carried by the authorized personnel. Alternatively the code may be biometric data which retains a lifelong distinctive identity of the authorized personnel. This document does not however disclose the recordal of an image by a camera in the direction in which a shot is in used fired or the recordal of a sound at about a time when a shot is in used fired.

International patent application number PCT/US93/10156 discloses a light-energy initiated firing system for a firearm. Optical light-conducting fibres extend from a source of high frequency energy to adjacent a cartridge so that the energy passing through the fibres will pass into the cartridge and initiate a propellant in the cartridge. The firearm cartridge includes an ignition composition (a primer) positioned forward of at least part of the propellant. High frequency energy such as laser energy passes into the cartridge and initiates the forward-positioned propellant. The system includes safety means for_interupting the energy path. Again this document does not disclose recordal of an image or a sound at the time when a shot is in use fired.

U.S. Pat. No. 4,309,095 discloses a camera mounting device for mounting a camera to a hunting rifle. The camera is mechanically operated when a trigger for the rifle is pulled and a digital camera is not disclosed. The camera of U.S. Pat. No. 4,309,095 is also attached to the rifle or a telescope for the rifle and is not integral with the rifle or firearm used. The taking of a photograph is not a precondition for the firing of the rifle disclosed in U.S. Pat. No. 4,309,095.

DISCLOSURE OF THE INVENTION

According to the present invention a firearm device comprises

- a firearm;
- safety means for impeding an unauthorised person to fire the firearm; and
- information storage means for recording and storing at least one aspect of the group consisting of an image in the direction in which a shot is in use fired, sound at about the time when a shot is in use fired, time when a shot is in use fired, and location of the firearm.

The firearm may comprise a conventional firearm or any other firearm for firing a projectile. The firearm may comprise a rifle but preferably it comprises a handgun.

In one preferred embodiment of the invention the firearm may include a laser system for generating a laser beam to ignite a charge to fire a projectile. The firearm preferably also includes an electronic system for controlling firing of the firearm. The firearm may also include a number of barrels and preferably the barrels are pre-loaded with projectiles and charges, which charges are ignitable by means of a laser beam. It will be appreciated that radiation other than laser beams may possibly be used to ignite the charge.

The safety means may comprise a mechanical means such as means whereby access to a trigger member on the firearm or pulling of such trigger member is blocked, and access to the trigger member or pulling thereof can only be achieved by unlocking the safety means.

In a preferred embodiment the safety means may comprise an information carrier and/or gathering means; and a processing means for processing information received from the information carrier and/or gathering means and allowing firing of the firearm to take place only if the information so received complies with certain requirements.

The information carrier and/or gathering means may include an information carrier means whereupon information can be recorded. The carrier means may comprise a card such as a smart card or similar device. In use the card may have information recorded thereon in respect of, for example, physical information of the authorised user for identifying said user, for example a skin print (particularly a fingerprint) or the like. Information regarding voice, retina, DNA may also be considered. The card may also include details thereon regarding the license of the firearm.

The safety means may also include reading means for reading information on the information carrier means.

The information carrier and/or gathering means may include information gathering means which may comprise means for gathering certain physical information from the person to use the firearm, preferably information whereby said person can be identified. The gathering means may comprise means for recording information such as skin prints particularly a fingerprint), voice, retina scanning, DNA identification or the like.

Preferably the information carrier and/or gathering means includes both an information carrier means and an information gathering means.

The processing means may also include a memory means for storing information therein. In use the processing means may compare information received from the information carrier and/or gathering means with information on the memory means and only allow firing to take place if the information corresponds. The processing means may comprise a micro-processor.

In one example the authorised users thumbprint may be stored on the card and it may be stored on the memory means. In use firing will only be allowed by the processing means if the thumbprint on the card is the same as that on the memory of the processing means and the same as that received by the information gathering means which in use takes a thumb print of the person holding the firearm.

The safety mechanism may also be adapted in order that the firearm can be de-activated to prevent firing, in a similar way that a cellular phone is blocked. This can be used to de-activate the firearm when it gets stolen, or when the license expires (if firearm licenses are made valid for a certain period of time only). The firearm can also be programmed to be operational for a specific period of time only, for example when the authorised person (such as a policeman) is on duty.

A remote controllable device may also be installed for controlling the firearm device from a remote position.

The information storage means may comprise at least one device of the group consisting of a camera (such as a digital camera) for recording images; a microphone for recording sound; a timepiece for recording time; a GPS for recording position in the form of geographical co-ordinates; and the information storage means further comprising storage means for storing data from the said at least one device. Preferably the information storage means includes all of the said devices.

The camera may be mounted to face along the barrel defined by the firearm, thereby allowing it to record an image in the direction in which a shot is in use fired.

The timepiece may comprise any suitable timepiece for providing time and date. The timepiece may comprise a real time clock.

The firearm device may also include trigger for triggering the information storage means to record and store. Preferably the information storage means is so triggered when a trigger member defined by the firearm is pulled for firing a shot.

According to another aspect of the present invention there is provided a firearm device comprising a firearm; and safety means being characterised therein that it comprises an information carrier and gathering means defining an information carrier means separable from the firearm device whereon information can be recorded, and an information gathering means for gathering information from the person to use the firearm; and the safety means further comprising processing means for processing information received from the information carrier and gathering means and allowing firing of the firearm to take place only if the information so received complies with certain requirements.

Without thereby limiting the scope of the invention and by means of example only, one embodiment thereof will now be further described with reference to the accompanying drawings wherein.

In the accompanying drawings the same reference numerals are used to denote corresponding parts.

Figure 1:
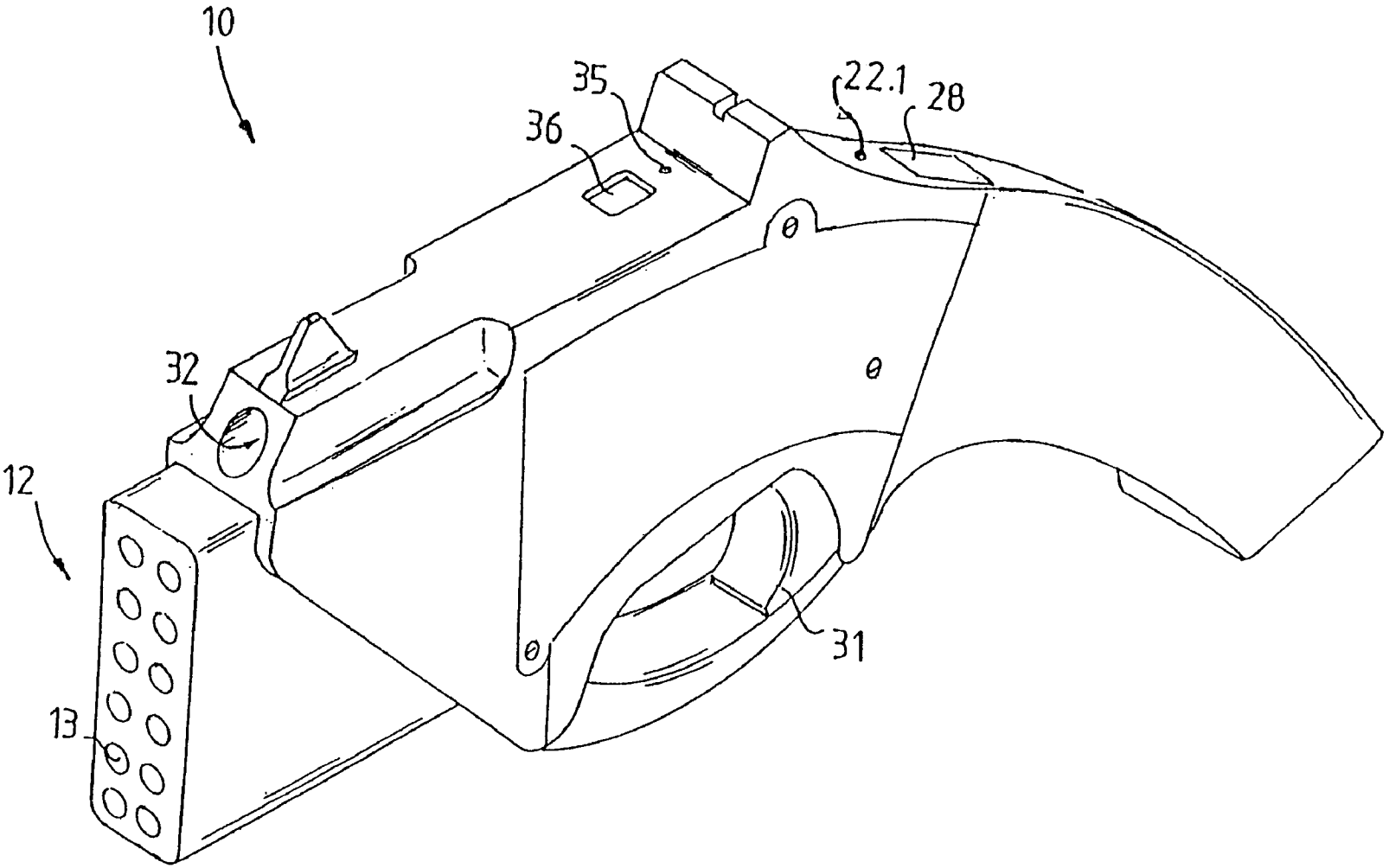
FIG. 1 is a perspective view of a firearm device according to the invention.
Figure 2:
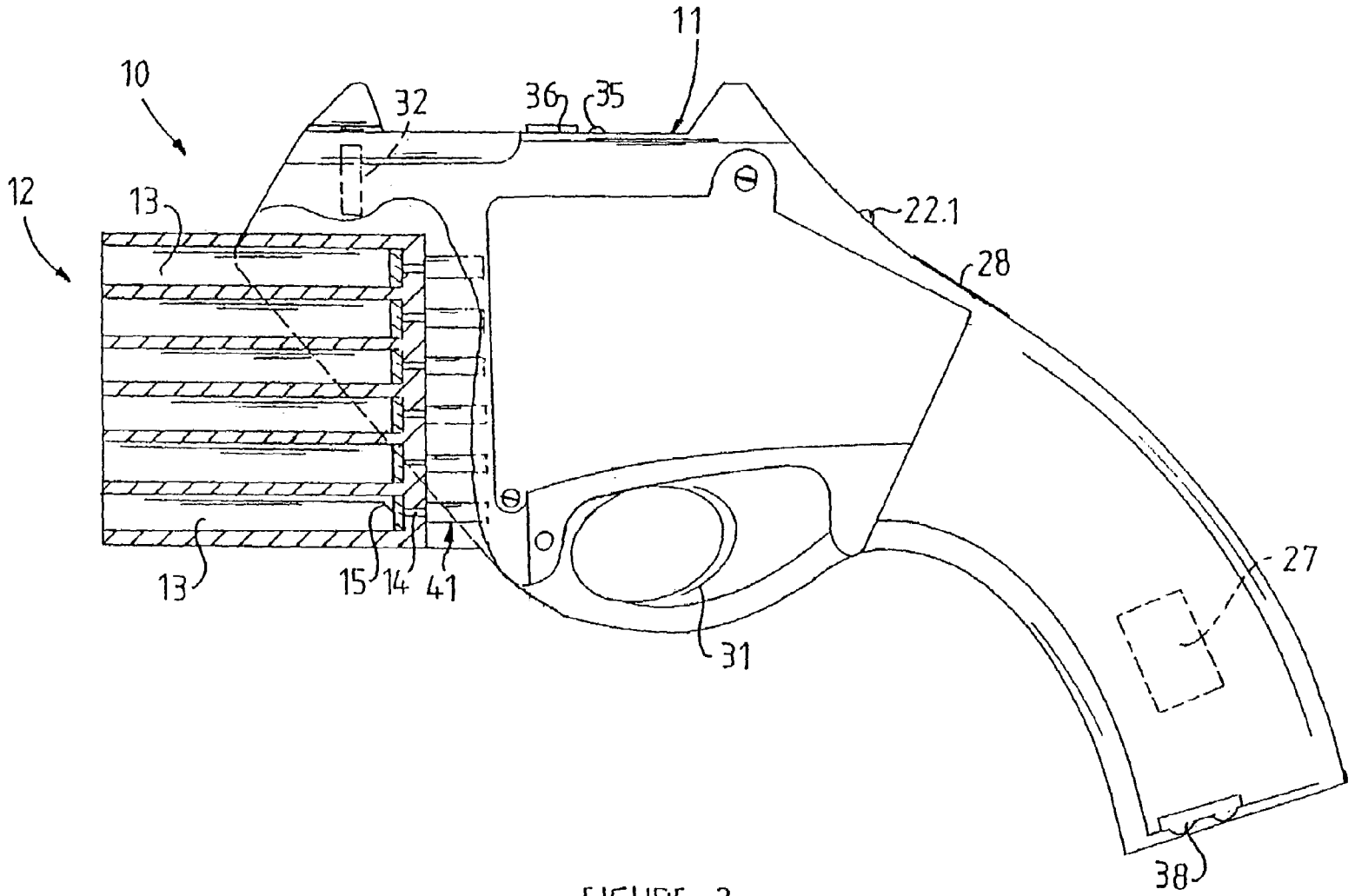
FIG. 2 is a partly sectioned side view of the device of FIG. 1.
Figure 3:
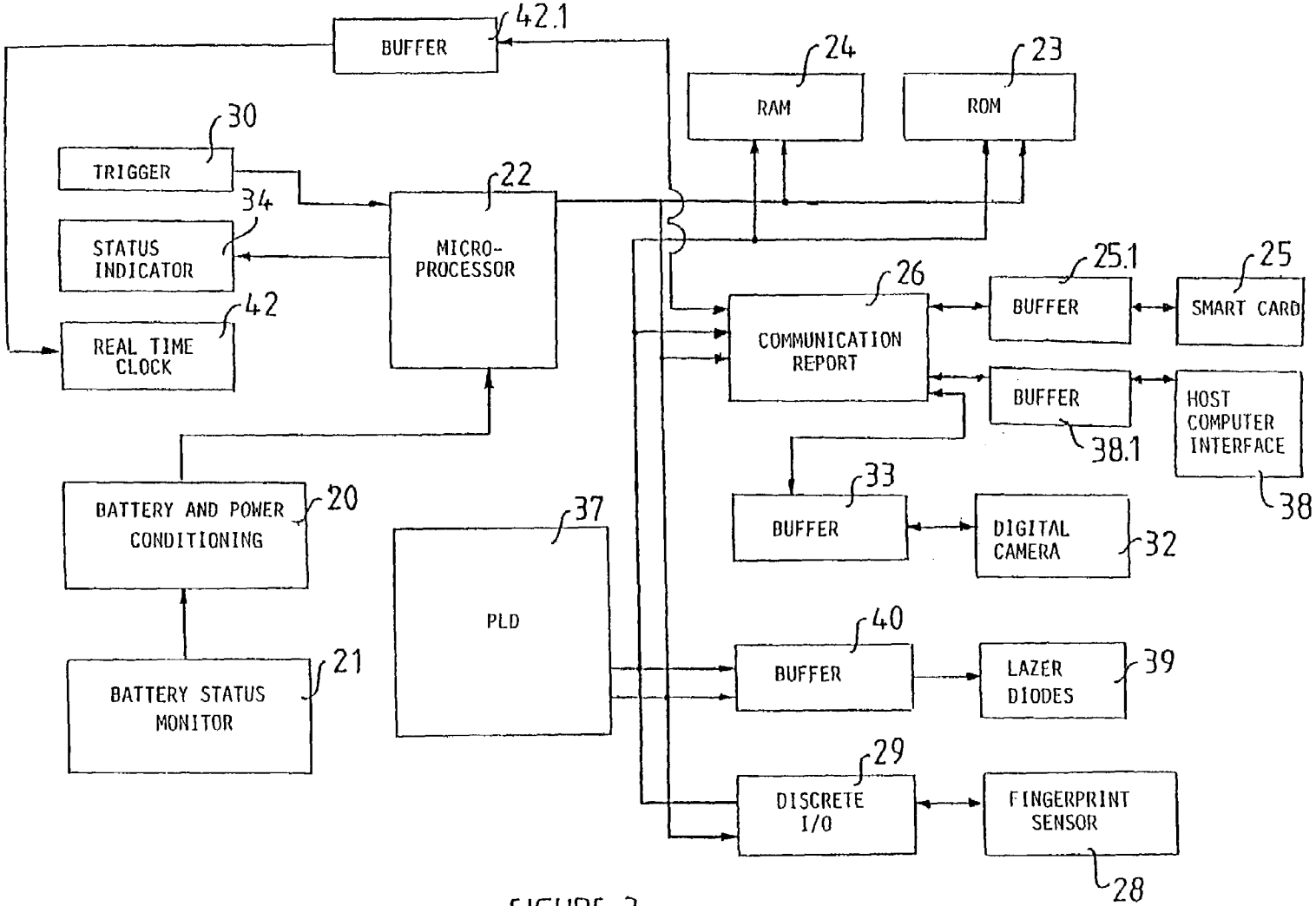
FIG. 3 is a simplified circuit diagram of the firearm of FIG. 1.

Referring now the drawings the firearm device 10 defines a firearm comprising a grip member 11 and a barrel member 12.

The barrel member 12 is releasably secured to the grip member 11 by means of a clip means [not shown] and locking means [not shown] is provided for locking the barrel member 12 to the grip member 11. In use the barrel member 12 may be replaced with another barrel member. Each barrel member 12 is provided with a unique code. In use the code may be entered against the name of the licensed owner of the firearm device 10. The licensed owner may be allowed to purchase more than one barrel member 12 at a time, depending on specific needs. Different barrel members 12 may include bores of different calibres. In use empty used barrel members 12 may be returned to dealers for credit when new barrel members 12 are purchased.

The barrel member 12 includes a number of barrels 13 therein. In this case twelve barrels 13 are provided in 6 pairs. At the rear of each barrel 13, a port 14 is provided for allowing a laser beam to pass through said port 14. The port 14 is closed by means of a closure member 15 made of a glass disc 4 mm thick. In use the closure member 15 allows a laser beam to pass though it but is of sufficient strength to withstand the blast of explosive material in the barrel 13, thereby retaining the port 14 closed.

Each barrel 13 is pre-loaded to include a primary loading [not shown] in the form of $VH_2$ supplied by PMP a division of Denel (Proprietary) Limited; a propellant [not shown] in the form of B556/1 propellant supplied by Somchem a division of Denel (Proprietary) Limited; and a projectile [not shown] made of a lead compound. The primary loading is located between the closure member 15 and the propellant, while the propellant is located between the primary loading and the projectile. Each projectile may be provided with a unique code whereby it can be identified. A composition [such as wax, preferably a microcrystalline wax] may be provided for retaining the projectile in position and may also serve to lubricate the projectile as it moves through a barrel 13 when fired.

In use a laser beam will pass through the port 14 and closure member 15 to ignite the primary loading. The primary loading will in turn ignite the propellant which will propel the projectile through a barrel 13 and away from the device 10.

The grip member 11 includes a power source therein in the form of a re-chargeable 6 volt battery 20 (including power-conditioning means) for supplying power to the electronic circuitry of the device 10. A battery status monitor 21 in the form of analogue circuitry, monitors the voltage of the battery 20 and is linked to a light emitting diode (LED) 22.1 which is activated when the voltage of the battery 20 drops below a certain predetermined value. The battery 20 may be charged through an interface [not shown] provided for this purpose.

A processing means in the form of a micro-processor 22 [comprising a TMS 320C32 unit supplied by Texas Instruments] is also provided in the grip member 11. The micro-processor 22 addresses the needs and monitors the functions of the peripherals and external components in the electronic circuit.

A ROM 23 in the form of a flash non-volatile memory chip is also provided for storing software and captured information. A RAM 24 in the form of static RAM provides temporary memory.

An interface for interfacing with an information carrier means 25 is also provided. The information carrier means is in the form of a smart card 25 [a Multiflex 8K unit supplied by Schlumberger]. The interface comprises a buffer 25.1 [a LTC 1755 unit supplied by Linear Technology]. The smart card 25 is connected to the micro-processor 22 through both the buffer 25.1 and a communications port 26 in the form of a ST16C1550 unit supplied by Startech.

In use information such as personal details of the user, firearm licence information and a thumbprint of the authorised user may be stored on the card 25. In use the card 25 is removable from the grip member 11.

An information gathering means in the form of finger print sensor 28 [a Fingertip unit (trade name) supplied by Infineon] is mounted onto the grip member 11 and is coupled to the micro-processor 22 through a discrete I/O signal generator 29.

A trigger 30 is also coupled to the micro-processor 22. Trigger 30 comprises a make-break switch and a trigger member 31 is used to close the make-break switch.

A timepiece defining a real time clock 42 in the form of a DS 1994 unit supplied by Dallas Semiconductor is also coupled to the micro-processor 22, through a buffer 42.1 and the communications port 26.

A camera 32 is coupled to the micro-processor through a buffer 33 and the communications port 26. The camera 32 comprises a digital camera in the form of a HDCS 2000 unit supplied by Hewlett Packard. The camera 32 is mounted in the grip member 11 to face along the barrel member 12 in use to allow an image to be captured in the direction wherein a bullet is fired.

The device 10 also includes a status indicator 34 which includes a LED 35 and a liquid crystal display (LCD) 36. The LED 35 indicates when the firearm device 10 is ready to fire and the LCD 36 indicates which barrels 13 have been fired.

A selection switch [not shown] may also be provided. This switch can be moved to an active position wherein the device 10 can fire and a non-active position wherein the device 10 can be used for practising when no shots will be fired.

The device 10 further includes a programmable logic device [PLD] 37. The PLD includes a glue logic function which ensures logic level compatibility between peripherals and external components in the electronic circuit. It also includes a watchdog timer which will reset the electronic circuitry under certain predetermined conditions such as where the system "hangs-up" or where unauthorised or unrecognised inputs are received. Furthermore, the PLD also includes an interrupt controller which controls the transmission of interrupt input signals to the micro-processor 22 in response to signals received from the peripherals and external components. The transmission of interrupt signals will be priority based depending on the peripheral or external component having data ready to transmit data to the micro-processor 22.

A host computer interface 38 is provided for communication with the peripherals and components of the electronic circuitry. The interface 38 can be used for downloading information from the ROM 23. The interface 38 may comprise an infra red transceiver comprising a TFDS 4500 unit supplied by Temic connected to the communications port 26 through a buffer 38.1.

A laser system comprising laser diodes 39 are also linked to the micro-processor 22 through a buffer 40. The diodes 39 comprise twelve QCW lasers [make IC8611 8E], one for each barrel 13. Each laser diode 39 is provided with an optical system 41 which directs and focuses a laser beam generated by the associated laser diode 39.

Software stored in the ROM 23 and/or PLD 37 and/or micro-processor 22 controls the activation of the laser diodes 39. The laser diodes 39 are normally activated in response to activation of the trigger 30. The laser diodes 39 are activated according to a predetermined sequence. This sequence may be changed by altering the software stored in the electronic circuitry. Said software, the trigger 30 and trigger member 31 defines an electronic system for controlling and firing the device 10.

It will be appreciated that the safety means of the device 10 comprises an information carrier and gathering means in the form of an information carrier means (the card 25); reading means (through the micro-processor 22) for reading the information on the card 25; and information gathering means in the form of the fingerprint sensor 28. The safety means further includes the processing means in the form of the micro-processor 22. The micro-processor 22 includes memory means and additional memory is provided through the ROM 23 and RAM 24.

The information storage means of the device 10 comprises the camera 32 and the timepiece in the form of the real time clock 31. The information storage means also includes storage means in the form of the ROM 23 for storing data received from the camera 32 and the real time clock 31.

In order to allow the device 10 to fire, the smart card 25 is inserted in the grip member 11 to communicate with the micro-processor 22. This allows for the reading and writing of information between the micro-processor 22 and the smart card 25. The micro-processor 22 is pre-programmed to include certain information. The micro-processor 25 will then compare information received from the smart card 25 with information stored thereon and if it complies with certain requirements the device 10 will be activated which will be indicated by the LED 35. For example, the smart card 25 and the micro-processor 22 may both include the thumb-print of the authorised user thereon and only if the print is the same will the device 10 be activated. The smart card 25 may also include information in respect of the firearm licence and the micro-processor 22 may prevent the device 10 from being activated if the licence is not valid (for example if a licence is only valid for a period of time).

The user will also place his thumb on the fingerprint sensor 28 and the micro-processor 22 will compare the print with that stored on the micro-processor 22 and on the smart card 25. Only if the print from the fingerprint sensor 28 is the same as that on the smart card 25 and the same as that stored on the micro-processor 22 will the micro-processor 22 allow the device 10 to fire. If one print is not the same as the others the device 10 will not be allowed to fire.

If the prints are the same and the trigger member 31 is then pulled to close the make-break switch of the trigger 30, the micro-processor 22 will activate the laser diodes 39 sequentially everytime the trigger member 31 is pulled. When a laser diode 39 is activated it will generate a laser beam which passes through an optical system 40, through a port 14 and closure member 15 to ignite the primary loading, causing a shot to be fired. The LCD 36 will indicate which barrels 13 have been fired.

Everytime a shot is fired the image as viewed along the barrel member 12 will be captured by means of the digital camera 32. The time at which each shot is fired will also be recorded by the real time clock 42 and stored on the ROM 23.

When a licence is renewed or when a new barrel member 12 is bought it will be possible to check when each shot was fired and at what it was fired. Since each projectile may be provided with a unique code it will also be known which projectile was fired. This information can be downloaded through the interface 38 to a host computer. It is believed that this will result in more responsible use of the device 10. The device 10 may also be programmed to be operable for only a certain period of time, and in order to continue use, the firearm will have to be taken to the authorities which can then download information stored on the device 10.

The device 10 may also include a microphone [not shown] for capturing sounds at about the time the trigger member 31 is pulled. A global positioning system (GPS) may also be included in the device 10 to record the position of the device 10 when a shot is fired. The device 10 may also be programmed not to fire when it is in certain locations (e.g. game parks).

The device 10 may also include a transmitter and/or receiver [not shown].

Through such a receiver the firearm may be de-activated from a remote position e.g. if the device 10 is stolen or if the license expires. Alternatively, if it includes a transmitter, information stored on the device 10 may be transmitted to a remote position. This feature provides a remote controllable device for controlling the firearm device 10 from a remote position.

It will be appreciated that many variations in detail are possible without thereby departing from the scope and spirit of the invention. One such variation is for example to replace at least some of the components in the electronic circuit by an ASIC developed for such a purpose.

What is claimed is:

1. A firearm device comprising:

a firearm;

a safety means for impeding an unauthorized person to fire the firearm; and an information storage means for recording and storing at least one aspect of a group consisting of an image in the direction in which a shot is fired, and a sound at about the time when a shot is fired, wherein the safety means comprises an information carrier means whereupon information can be recorded, a reading means for reading information on the information carrier means, an information gathering means for gathering physical information from a person to use the firearm, whereby said person can be identified; and a processing means for processing information received from the information carrier and gathering means and allowing firing of the firearm to take place only if the information so received complies with one or more physical requirements.

2. The device of claim 1, wherein the firearm comprises a conventional firearm and wherein the information storage means stores a unique code relating to each projectile fired.

3. The device of claim 1, wherein the firearm includes a laser system for generating a laser beam to ignite a charge to fire a projectile.

4. The device of claim 3, wherein the firearm includes an electronic system for controlling firing of the firearm.

5. The device of claim 3, wherein the firearm includes a number of barrels and wherein the barrels are pre-loaded with projectiles and charges, which charges are ignitable by means of a laser beam.

6. The device of claim 1, wherein the carrier means comprises a card.

7. The device of claim 6, wherein the card has information recorded thereon in respect of physical information of the authorised user for identifying said user.

8. The device of claim 7, wherein the physical information comprises a fingerprint.

9. The device of claim 1, in which the information gathering means is located on an operatively rear surface of a grip member of the device.

10. The device of claim 1, wherein the gathering means comprises means for recording a fingerprint of the person to use the firearm.

11. The device of claim 10, in which the means for recording a fingerprint is located on an operatively rear side of a grip member of the device.

12. The device of claim 11, in which the gathering means is located on the device such that a fingerprint of a user of the device can be recorded when the device is located in a holster therefor.

13. The device of claim 1, wherein the processing means includes a memory means for storing information therein and the processing means in use comparing information received from the information carrier and gathering means with information on the memory means and only allowing firing to take place if the information corresponds.

14. The device of claim 1, wherein the information storage means is connected to at least one device of a group consisting of a digital camera for recording images, a microphone for recording sound, a timepiece for recording time, and a GPS for recording position in the form of geographical co-ordinates; and the information storage means is arranged to store data from the said at least one device.

15. The device of claim 14 which includes a digital camera and a timepiece.

16. The device of claim 15, wherein the digital camera is mounted to face along the barrel defined by the firearm, thereby allowing it to record an image in the direction in which a shot is fired.

17. The device of claim 15, wherein the timepiece comprises a real time clock.

18. A firearm device comprising:

a firearm; and a safety means being characterized therein that it comprises an information carrier and gathering means defining an information carrier means separable from the firearm device whereon information can be recorded, and an information gathering means for gather information from the person to use the firearm; and the safety means further comprising processing means for processing information received from the information carrier and gathering means and allowing firing of the firearm to take place only if the information so received complies with one or more physical requirements, and recording at least one aspect of a group consisting of an image in the direction in which a shot is fired, and a sound at about the time when a shot is fired.

* * * * *